United States Patent [19]

Epis

[11] 3,990,079

[45] Nov. 2, 1976

[54] LOG-PERIODIC LONGITUDINAL SLOT ANTENNA ARRAY EXCITED BY A WAVEGUIDE WITH A CONDUCTIVE RIDGE

[75] Inventor: James J. Epis, Sunnyvale, Calif.

[73] Assignee: GTE Sylvania Incorporated, Mountain View, Calif.

[22] Filed: June 23, 1975

[21] Appl. No.: 589,476

[52] U.S. Cl. ..... 343/771; 343/792.5; 333/95 R; 333/98 R

[51] Int. Cl.[2] ..... H01Q 13/10

[58] Field of Search ..... 343/771, 770, 792.5, 343/705, 708

[56] References Cited

UNITED STATES PATENTS

| | | | |
|---|---|---|---|
| 2,648,839 | 8/1953 | Ford et al. | 343/771 |
| 2,929,065 | 3/1960 | Kreinheder | 343/770 |
| 3,346,865 | 10/1967 | Jones, Jr. | 343/708 |
| 3,530,478 | 9/1970 | Corzine et al. | 343/792.5 |
| 3,555,232 | 1/1971 | Bleackley | 343/771 |
| 3,604,010 | 9/1971 | Schwartz | 343/771 |
| 3,633,207 | 1/1972 | Ingerson | 343/770 |

FOREIGN PATENTS OR APPLICATIONS

| | | | |
|---|---|---|---|
| 613,314 | 1/1961 | Canada | 343/771 |

*Primary Examiner*—Alfred E. Smith
*Assistant Examiner*—David K. Moore
*Attorney, Agent, or Firm*—John F. Lawler

[57] ABSTRACT

A log-periodic longitudinal slot antenna array comprises a dimensionally linearly tapered ridged waveguide having top and bottom walls, either forming part of a metallic ground plane and in which longitudinally elongated and spaced slots are formed. The long axis of each slot is parallel to the longitudinal component of the magnetic field in the waveguide and the slots have dimensions and inter-slot spacings which decrease in increments of a predetermined ratio $\tau$ in a direction toward the smaller end of the tapered waveguide. The antenna produces a fan-shaped beam with its narrow radiation pattern lying in the E-plane of the waveguide when fed at either the large or small end of the waveguide or both, the boresight axes of the resultant independent beams being different for the two feed points. For bi-directional radiation, a similar array of slots is formed in both the top and bottom walls of the waveguide either or both of which optionally may comprise extended ground planes.

12 Claims, 14 Drawing Figures

LOG-PERIODIC LONGITUDINAL SLOT ANTENNA ARRAY EXCITED BY A WAVEGUIDE WITH A CONDUCTIVE RIDGE

CROSS REFERENCE TO RELATED APPLICATION

Ser. No. 589,475 filed June 23, 1975 for Log-Periodic Longitudinal Slot Antenna Array.

BACKGROUND OF THE INVENTION

This invention relates to slot antennas and more particularly to a broadband log-periodic slot antenna array.

The use of the log-periodic dipole antenna array for psuedo frequency-independent operation is well known. There are many applications, however, which require a flush-mounted antenna such as one designed for the surface of an aircraft and for these uses the dipole antenna array is not suitable. The slot antenna array is particularly well adapted to such flush-mounted applications since the radiating elements are slots themselves formed in a waveguide wall which may be part of a ground plane constituting the metallic skin of the aircraft.

Log-periodic cavity-backed transverse slot antenna arrays have been proposed in the past in an effort to duplicate the operating characteristics of the dipole counterpart but have met with only limited success. For example, such an antenna is described in an article entitled "A Log-Periodic Cavity-Backed Slot Log-periodic cavity-backed by V. A. Mikenas and P. E. Mayes, 1966 IEEE - PGAP Symposium Digest, Palo Alto, California.

SUMMARY OF THE INVENTION

A general object of this invention is the provision of unidirectional log-periodic psuedo frequency-independent antennas which can be mounted completely flush to a metallic ground plane and produce antenna beams of moderately high gain which are boresighted in a large variety of directions depending upon the specific version of the invention.

Another object is the provision of broadband log-periodic antennas with fan-shaped beams.

A further object is the provision of a log-periodic antenna whose gain and beamwidth and beam-boresight direction are variable appreciably simply through change of one or more of the available design parameters and without arraying two or more antennas.

Still another object is the provision of a dual-mode log-periodic antenna structure capable of supplying two independent unidirectional patterns or fan-shaped beams boresighted in different directions, and wherein these antenna beams can be produced either simultaneously or one at a time.

A further object is the provision of a log-periodic slot antenna array which is capable of producing either two independent bi-directional fan-shaped beams or a single bi-directional fan-shaped beam.

These and other objects of the invention are achieved with a linearly tapered ridged waveguide having a log-periodically related array of slots formed in one of the waveguide walls with any pair of consecutive slots being located on opposite sides of the plane of the electric (E) field in the waveguide, called the E-plane of the waveguide, for unidirectional radiation. This antenna may be fed from either or both ends of the waveguide and produces fan-shaped beams boresighted at different angles from broadside (normal to the ground plane) depending upon which end of the waveguide constitutes the antenna feed point. Bi-directional fan-shaped beams are produced with a similar waveguide structure having a log-periodic array of slots formed in each of two such waveguide walls that extend transversely of the E-plane of the waveguide.

DESCRIPTION OF PREFERRED EMBODIMENTS

One physical distinction between unidirectional versions of antennas embodying this invention and those of the invention described in the cross-referenced application Ser. No. 589,475 is that in the present invention any pair of consecutive slot radiators are situated on alternate or opposite sides of the E-plane of the tapered waveguide, whereas all slot radiators are on the same side of that plane in the unidirectional antennas of the cross reference. A second physical distinction is that all slots in unidirectional antennas of the present invention are on either a top wall or a bottom wall of the waveguide, but never in both of those walls in one and the same antenna version, whereas the slots in any unidirectional antenna of the cross-referenced invention are all on a top wall, or all on a bottom wall, or all on one of either of the two side walls, where the electric field in the waveguide is perpendicular to the top and bottom walls and is vanishingly small at both side walls. The electrical distinction due to these physical distinctions is profound because the partial time phase difference between the electric field excitations in any consecutive pair of slots, which partial phase difference is the component of total phase difference due solely to the transverse location of those slots, is 180° in antennas of this invention but zero degrees in antennas of the cross-referenced invention. The practicably important net result of this difference is that, for operation over the same frequency band, a given antenna of the present invention is physically about one-half as long as the corresponding antenna in the cross-referenced invention, so that the power gain of the fan-shaped beam provided by the latter antenna is about twice as high as (or three db more than) that of the corresponding antenna of the present invention. Antenna versions in the present invention are therefore more suitable for those applications in which space is limited and/or it is desirable to employ fan-shaped beams whose narrow radiation pattern beamwidths are about twice those of corresponding antennas in the cross-referenced invention.

Figure 1:
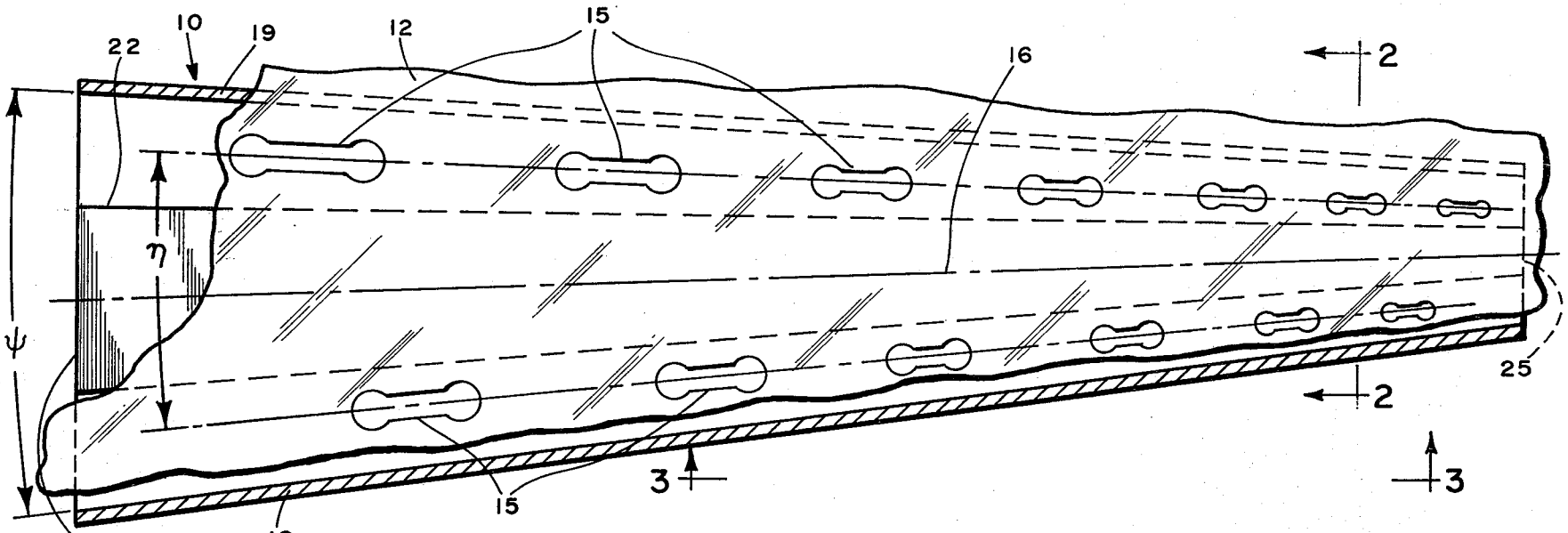
FIG. 1 is a plan view of the ground plane side of an antenna embodying this invention.
Figure 3:
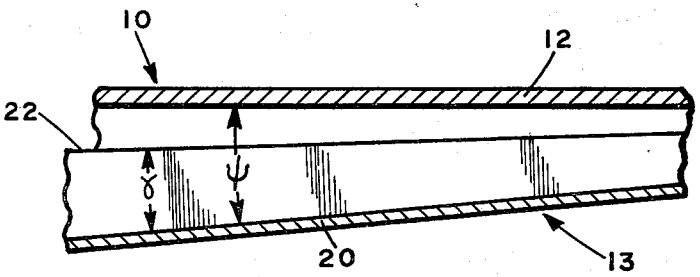
FIG. 3 is a section taken on line 3—3 of FIG. 1.
Figure 2:
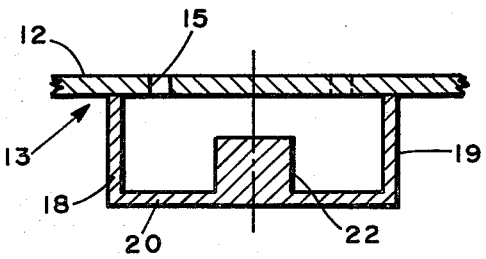
FIG. 2 is a section taken on line 2—2 of FIG. 1.

Referring now to the drawings, an antenna 10 embodying this invention is shown in FIGS. 1, 2 and 3 and comprises a ground plane 12 forming part of the top wall of a linearly tapered ridged waveguide 13. The portion of the ground plane constituting the waveguide top wall has a plurality of slots 15 formed on opposite sides of the electric field center plane 16 of the waveguide with inter-slot spacing and slot dimensions decreasing in increments of a predetermined ratio $\tau$ in accordance with log-periodic antenna design. In other words, the dimensions and inter-slot spacings are log-periodically related in accordance with the following relationship:

$$d_m = d_{m-1}/\tau$$

where $d_m$ is any dimension of the mth slot, $d_{m-1}$ is the corresponding dimension of the next smaller slot, and $\tau$ is a numerical constant.

Waveguide 13 has side walls 18 and 19 and a bottom wall 20 opposite ground plane 12. A ridge 22 projects inwardly from bottom wall 20 of the waveguide. The cross-sectional dimensions of the waveguide taper from a maximum dimension at one end 24 to a minimum at the opposite end 25 with the top and bottom waveguide walls converging at an angle $\Psi$, the side walls at an angle $\theta$, the ridge height at an angle $\gamma$ and its width at an angle $\alpha$.

Slots 15 are longitudinally elongated preferably dumbbell-shaped apertures with axes substantially parallel to the longitudinal axis of the waveguide and arranged in two rows on opposite sides of the center E-plane 16. The rows of slots converge at an angle $\eta$ and each row is optimally spaced between center plane 16 and the adjacent side wall for suitable coupling of energy from the waveguide to free space. If this spacing is made quite small, the "active" or "radiating" region on the structure is increased in length and the beamwidth of the narrow radiation pattern on the fan-shaped beam is decreased in a satisfactory manner if the value of $\tau$ is increased and/or slots of lower Q are employed. Hence, dumbbell-shaped slots are illustrated in this embodiment of the invention, but ridged slots and even simple rectangular slots are also usable and useful.

Figure 4:
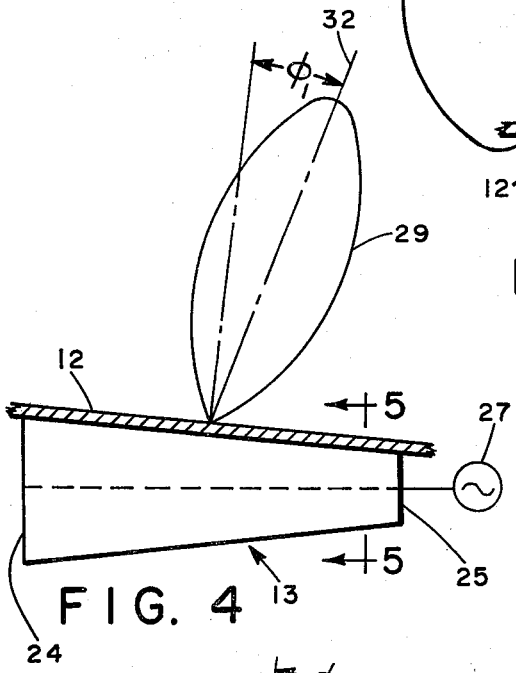
FIG. 4 is a partly schematic view of the antenna similar to FIG. 3 showing a typical H-plane radiation pattern when the tapered waveguide is fed at the smaller or right end as viewed.
Figure 6:
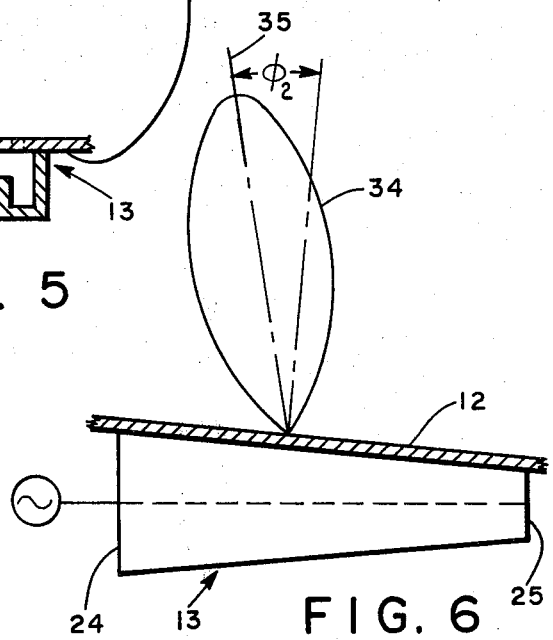
FIG. 6 is a view similar to FIG. 4 in which the antenna is fed at the larger or left end as viewed of the waveguide.

An important and unique feature of this invention is that the antenna 10 is energized by feeding the waveguide 13 either at its smaller end 25 as shown in FIG. 4, or at its larger end 24 as shown in FIG. 6, or at both ends simultaneously. The source of electromagnetic wave energy is indicated schematically at 27 and preferably consists of an oscillator or pulse generator or the like suitably coupled to the waveguide. It should be understood that the source 27 may also comprise a receiver or the like when the antenna is used in the receiving rather than the transmitting mode.

Figure 5:
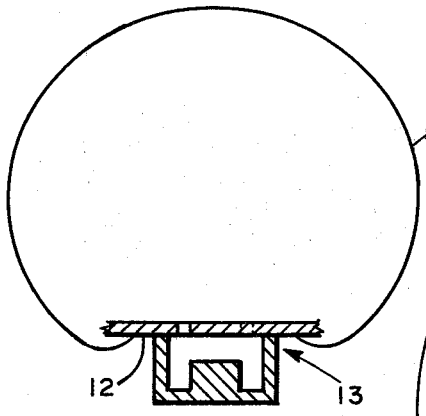
FIG. 5 is a section taken on line 5—5 of FIG. 4 and showing the radiation pattern in its E-plane.

The H-plane radiation pattern 29 shown in FIG. 4 is relatively narrow with a half-power beamwidth of approximately 20° with the exact value depending on the particular antenna version, whereas the radiation pattern 31 in the E-plane, see FIG. 5, is considerably broader.

Thus the radiation beam produced by this antenna is fan-shaped and is ideally suited for applications such as azimuth or elevation direction finding, countermeasures and electronic surveillance. Beam 29 is boresighted in directions varying from approximately broadside to as much as 35° from broadside in the direction of $\phi_1$ in FIG. 4, the exact value of $\phi_1$ depending on the specific antenna version. The radiation is thus reasonably close to broadside, or psuedo-broadside, when the waveguide is fed at its smaller end 25; in two different test models, beam axis 32 was measured at 9° and 0° from broadside toward the feed end. The operating bandwidth of this test model antenna when fed at either end was broad, being in the order of 1.65:1 with a VSWR of 1.3:1 or less at all frequencies in the useful bandwidth; furthermore, this specific operating bandwidth in either case was definitely capable of being extended to at least 2.25:1 by merely increasing the length of the antenna model and adding more slots. The operating bandwidth of certain versions of these antennas when fed at their smaller ends, however, is larger than when fed at their larger ends because deleterious effects due to the excitation of higher order modes of propagation is thereby accommodated while sufficient coupling of energy to free space is achieved. In such special cases, or as the bandwidth is extended to bandwidths approaching or exceeding 2 octaves, the slot radiators in the unidirectional antennas preferably are also located at strategic or special locations and only on the top wall or only on the bottom wall.

Another important and unique feature of this invention is the capability of the antenna to generate a separate and independent beam when the waveguide is fed at its larger end. As illustrated in FIG. 6, this beam 34 also has a relatively narrow width in the H-plane and has a boresight axis 35 inclined at an angle $\phi_2$ from the broadside normal 36 to the ground plane and toward the larger waveguide end as shown. The boresight angle $\phi_2$ typically is variable from about 45° to 10° from broadside. In two different test models, $\phi_2$ was measured at 27° and 23° from broadside toward the large end of the waveguide. The antenna embodying this invention therefore produces two independent beams 29 and 34 when fed at the large and small ends of the waveguide, and these beams may be generated separately or simultaneously as is desired or required.

Figure 7:
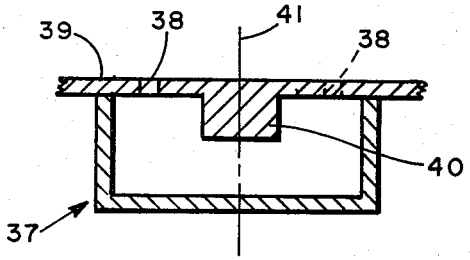
FIGS. 7–11, inclusive, illustrate modified forms of ridged waveguide feed structures for the antenna embodying the invention.

The invention may also be practiced with advantage in other differently shaped waveguide configurations. As shown in FIG. 7, the singly-ridged waveguide 37 has slots 38 formed in the waveguide wall 39 from which ridge 40 projects. Wall 39 is preferably part of a ground plane, although not required to be so. Longitudinally successive slots 38 are on opposite sides of the waveguide E-plane 41 as shown.

Figure 8:
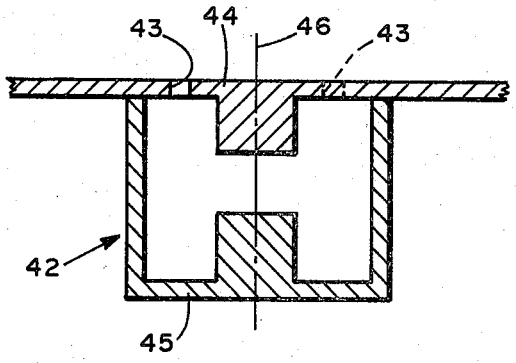

FIG. 8 illustrates another form of the invention with rectangular doubly-ridged waveguide 42 instead of the singly-ridged waveguide of FIG. 7. Longitudinally consecutive slots 43 in one of the ridged walls 44 and 45 are on opposite sides of the E-plane 46.

Figure 9:
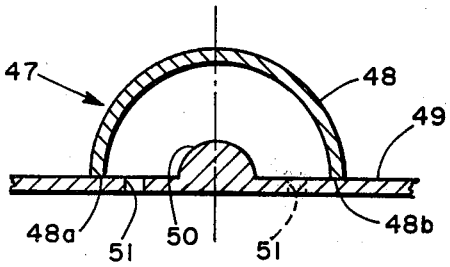

FIG. 9 illustrates another form of the invention in which waveguide 47 comprises a semicylindrical wall 48, a plane wall 49 connecting the longitudinal edges **48*a* and 48*b* of wall 48, and a semicylindrical ridge 50 on wall 49 coaxially of wall 48. Slots 51 are located in longitudinal succession on opposite sides of ridge 50.**

Figure 10:
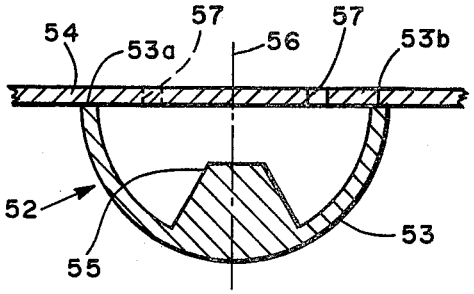

FIG. 10 illustrates another form of the invention in which waveguide 52 comprises a semicylindrical wall 53 having longitudinal edges **53*a* and 53*b* connected to a plane wall 54 which may be a ground plane. A trapezoidally shaped ridge 55 projects from wall 53 toward wall 54 symmetrically about E-plane 56. Slots 57 are formed in plane wall 53** alternately on opposite sides of the E-plane.

Figure 11:
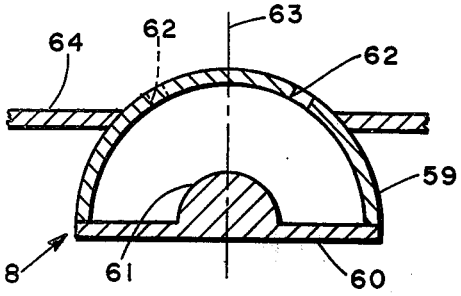

FIG. 11 shows another form of the invention with a waveguide 58 comprising a semicylindrical wall 59 connected at its longitudinal edges to plane wall 60 from which semicylindrical ridge 61 projects coaxially of wall 59. Slots 62 are formed in wall 59 alternately and on opposite sides of E-plane 63 and ground plane wall 64 and plane wall 60.

Figure 13:
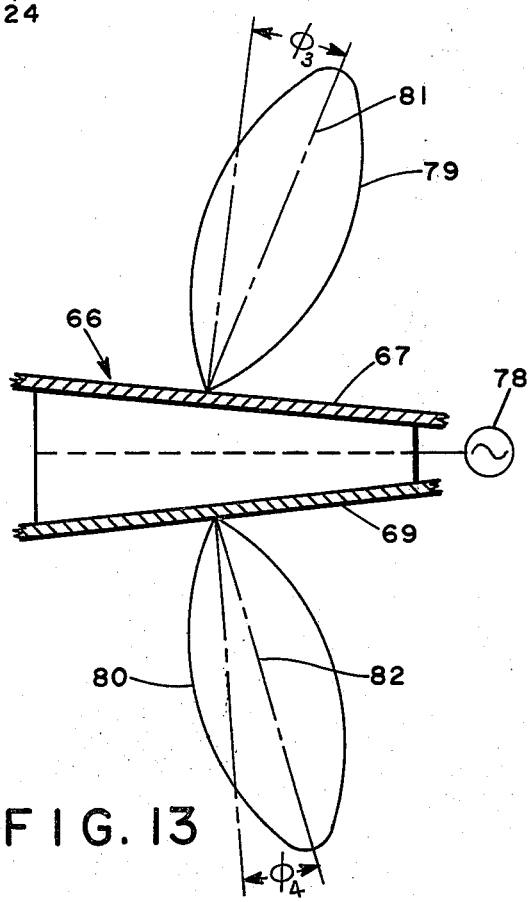
FIG. 13 is a schematic section similar to FIG. 6 showing a bi-directionally radiating antenna when fed at the smaller end of the feed waveguide.
Figure 14:
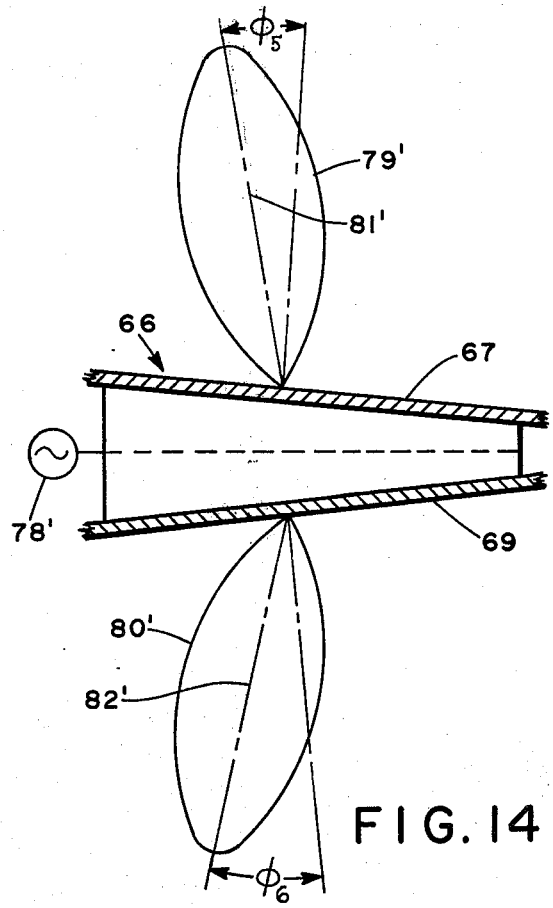
FIG. 14 is a view similar to FIG. 13 in which the antenna is fed at the larger end of the feed waveguide.
Figure 12:
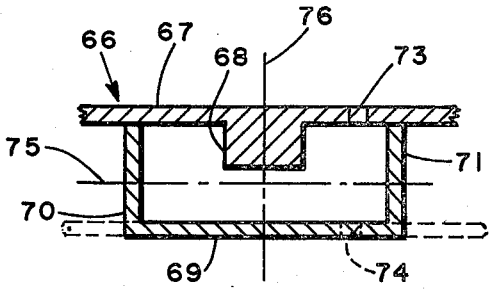
FIG. 12 is a transverse section similar to FIG. 7 showing a modified form of an antenna structure embodying the invention which is capable of bi-directional radiation.

In the foregoing embodiments of the invention, unidirectional radiation of energy over a broad band of frequencies and with a fan-shaped beam is accomplished. Bi-directional radiation is also achievable in accordance with this invention with an antenna 66 shown in FIG. 12 comprising a singly-ridged waveguide having a top wall 67 forming part of the ground plane and from which ridge 68 projects, a bottom wall 69 and side walls 70 and 71. Elongated preferably dumbbell-shaped slots 73 and 74 are formed in the top and bottom walls, respectively, with their axes substantially parallel to the longitudinal axis of the waveguide as described above but with longitudinally successive slots on opposite sides of the waveguide H-plane 75 and with all slots on the same side of the E-plane 76. The intrinsic phases of these successive slots are 180° apart in time because they are on opposite walls. The waveguide and slots and slot spacings are linearly tapered in size from one end of the antenna to the other as described above. The slot spacing from the E-plane 76 is variable as described above and for the same reasons as described above except with reference here to the narrow radiation patterns of each of the two beams as shown in FIGS. 13 and 14. Wall 69 in FIG. 12 may also be part of an extended ground plane as indicated in broken lines. It will be understood that the singly-ridged waveguide configuration of FIG. 12 is given by way of example and not by way of limitation since bi-directional radiation may be achieved in accordance with this invention with the other types of linearly tapered ridged waveguide described above and shown in cross section in FIGS. 8–11, inclusive.

FIG. 13 illustrates schematically the H-plane bi-directional radiation patterns produced by antenna 66 when fed from source 78 at the small end of the waveguide. Both walls 67 and 69 are illustrated as being parts of extended ground planes. Beams 79 and 80 project along boresight axes 81 and 82, respectively, at angles $\phi_3$ and $\phi_4$ to psuedo-broadside, which angles may vary from about 35° to ° of being perpendicular to the planes of the waveguide top and bottom walls. When the antenna is fed from source 78' at the large end of the waveguide as shown in FIG. 14, however, the axes 81' and 82' of the beams are inclined at angles $\phi_5$ and $\phi_6$, respectively, from broadside and in a direction toward the large end of the antenna.

If antenna 66 is fed from both the larger and smaller waveguide ends simultaneously, both the psuedo-broadside and more angularly disposed radiation patterns will result simultaneously.

An antenna of the type shown in FIGS. 1–3, inclusive, has been built and successfully tested. The design parameters and performance characteristics of this antenna when fed at the small end of the waveguide are as follows:

| | | |
|---|---|---|
| Axial length of waveguide | | 18.016 inches |
| Waveguide cross section: | | |
| Singly-ridged, rectangular | | |
| Slots in top waveguide wall | | |
| Log-periodic ratio $\tau$ | | 0.96336 |
| Type of slot | | dumbbell-shaped |
| Total number of slots | | 19 |
| Spacing between two largest slots | | 1.2089 inches |
| Electrical design parameter: | | |
| K = any slot resonant frequency divided by local cut-off frequency in the tapered waveguide | | 2.47 |
| Boresight (beam axis) relative to broadside (normal to ground plane) | | |
| Small end feed ($\phi_1$) | | 9° ± 2° |
| Large end feed ($\phi_2$) | | 27° ± 2° |
| Operating bandwidth (both feed cases) | | 1.63:1 |
| Operating frequency range | | 4.3 GHz to 7.0 GHz |
| Gain (all frequencies): | | |
| Small end feed | | 9 ± 0.5 db |
| Large end feed | | 8.7 ± 0.6 db |
| Input VSWR (all frequencies) both feeds | | < 1.3 |
| Beamwidths (all frequencies) | | |
| Small end feed | H-plane | 20° ± 2° |
| | E-plane | 125° nominal |
| Large end feed: | H-plane | 26° ± 2° |
| | E-plane | 100° nominal |

A second model of an antenna embodying this invention was also constructed and successfully tested. This model was nearly the same physically as the first model described above, the main difference being that K = 2.52 instead of 2.47, and each of 18 corresponding inter-slot spacings was slightly larger because the second antenna employed 18 slots instead of 19 over the same 18.016 inch length of waveguide. The radiation pattern beamwidths were closely comparable to those of the first model but the boresight directions of the fan-shaped beams at all frequencies were at $$\phi_1 = 0° \pm 2° \text{ and}$$

$$\phi_2 = 23° \pm 2°$$

The bandwidths of the foregoing antenna models for each feed case are definitely capable of being extended to at least 2.25:1 by making each antenna and tapered waveguide longer and adding more slots in a log-periodic fashion.

What is claimed is:

1. A broadband antenna comprising a closed electrically conductive TE-mode ridged waveguide linearly longitudinally tapered between a first end having a maximum cross-sectional dimension and a second end having a minimum cross-sectional dimension, said waveguide having a first wall from which a conductive ridge projects and a second wall opposite said first wall and being adapted to longitudinally propagate TE-mode electromagnetic waves having a transverse electric (E) field vector, a transverse magnetic ($H_T$) field vector component orthogonal to said E-field vector and a longitudinal magnetic ($H_L$) field vector with the E-field vector normal to said first and second walls, said waveguide having orthogonal central E and H planes parallel to said E-field and to said transverse $H_T$-field components, respectively, at least one of said walls having a plurality of longitudinally spaced slots formed with both the spacing between longitudinally adjacent slots and the slot dimensions decreasing in increments of a predetermined ratio from said first end of the waveguide to said second end, each of said slots being longitudinally elongated substantially in the direction of wave propagation, and energy feed means connected to at least one of said ends of said waveguide whereby the energy radiation pattern is a beam boresighted transversely of the slotted wall.

2. The antenna according to claim 1 in which said slots are formed along two lines converging in the direction toward said second waveguide end, said waveguide E-plane being centrally located between said two lines.

3. The antenna according to claim 1 in which said one of said walls comprises a portion of a ground plane member extending beyond said waveguide.

4. The antenna according to claim 1 with independent energy feed means connected to both ends of said waveguide whereby the resulting energy radiation constitutes two independent beams having angularly related boresight axes.

5. The antenna according to claim 1 in which each of said slots has a transversely ridged profile.

6. The antenna according to claim 5 in which the profile of each of said slots is dumbbell-shaped.

7. The antenna according to claim 1 with said slots being formed in said first and second walls on the same side of said waveguide E-plane and whereby said energy radiation pattern comprises a pair of beams boresighted transversely of and outwardly from said walls.

8. The antenna according to claim 1 in which said ridged waveguide has a rectangularly shaped cross-section.

9. The antenna according to claim 8 in which said second waveguide wall has a ridge projecting inwardly therefrom.

10. The antenna according to claim 1 in which said first wall is planar and said second wall is semicylindrical.

11. The antenna according to claim 10 in which said ridge is semicylindrical and disposed coaxially of said second wall.

12. The antenna according to claim 10 in which said ridge has a trapezoidally shaped cross-section and projects inwardly from said second wall.

* * * * *